US007735552B2

(12) United States Patent
Xu

(10) Patent No.: US 7,735,552 B2
(45) Date of Patent: Jun. 15, 2010

(54) PACKER CUPS FOR USE INSIDE A WELLBORE

(75) Inventor: Zheng Rong Xu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 174 days.

(21) Appl. No.: 11/291,010

(22) Filed: Nov. 30, 2005

(65) Prior Publication Data

US 2006/0219415 A1 Oct. 5, 2006

Related U.S. Application Data

(63) Continuation-in-part of application No. 11/093,390, filed on Mar. 30, 2005, now Pat. No. 7,331,581.

(51) Int. Cl.
*E21B 33/12* (2006.01)

(52) U.S. Cl. ..... 166/202; 277/335

(58) Field of Classification Search ..... 166/202, 166/387; 277/335
See application file for complete search history.

(56) References Cited

U.S. PATENT DOCUMENTS

| | | | | | |
|---|---|---|---|---|---|
| 1,459,509 | A | * | 6/1923 | Knothe | 277/335 |
| 1,730,804 | A | * | 10/1929 | Christenson, Jr. | 92/241 |
| 2,336,090 | A | | 12/1943 | Granger | |
| 2,723,721 | A | | 11/1955 | Corsette | |
| 2,835,329 | A | * | 5/1958 | True | 277/333 |
| 2,965,422 | A | * | 12/1960 | Wilson | 277/335 |
| 3,346,267 | A | * | 10/1967 | Farley | 277/335 |
| 3,398,655 | A | | 8/1968 | Waldrop | |
| 3,450,412 | A | * | 6/1969 | Collett | 277/335 |
| 4,106,182 | A | * | 8/1978 | Blackwell | 29/460 |
| 4,254,962 | A | * | 3/1981 | Blackwell | 277/335 |
| 4,317,407 | A | | 3/1982 | Blackwell | |
| 4,424,865 | A | * | 1/1984 | Payton, Jr. | 166/302 |
| 5,010,958 | A | * | 4/1991 | Meek et al. | 166/382 |
| 6,402,120 | B1 | | 6/2002 | Swaab | |
| 7,357,177 | B2 | * | 4/2008 | Garwood et al. | 166/202 |
| 2003/0098153 | A1 | * | 5/2003 | Serafin | 166/202 |
| 2005/0098313 | A1 | * | 5/2005 | Atkins et al. | 166/202 |

FOREIGN PATENT DOCUMENTS

| | | |
|---|---|---|
| GB | 2034372 | 6/1980 |
| GB | 2382364 | 5/2003 |
| WO | 0106087 | 1/2001 |

OTHER PUBLICATIONS

Super-Tough Carbon-Nanotube Fibers—A.B. Dalton et al., Nature vol. 423, Jun. 12, 2003, p. 703.

* cited by examiner

*Primary Examiner*—William P Neuder
(74) *Attorney, Agent, or Firm*—Michael L. Flynn; David Hofman; Robin Nava

(57) ABSTRACT

A packer cup for use inside a wellbore. In one embodiment, the packer cup includes a body, a support member disposed inside the body and one or more support layers disposed against an inside diameter of the support member.

22 Claims, 5 Drawing Sheets

PACKER CUPS FOR USE INSIDE A WELLBORE

CROSS-REFERENCE TO RELATED APPLICATIONS

This application is a continuation-in-part of co-pending U.S. patent application Ser. No. 11/093,390 entitled Carcass for Open Hole Inflatable Packers, filed Mar. 30, 2005, now U.S. Pat. No. 7,331,581 which is herein incorporated by reference.

BACKGROUND

1. Field of the Invention

Embodiments of the present invention generally relate to packer cups for use in a wellbore.

2. Description of the Related Art

The following descriptions and examples are not admitted to be prior art by virtue of their inclusion within this section.

Packer cups are often used to straddle a perforated zone in a wellbore and divert treating fluid into the formation behind the casing. Packer cups are commonly used because they are simple to install and do not require complex mechanisms or moving parts to position them in the wellbore. Packer cups seal the casing since they are constructed to provide a larger diameter than the casing into which they are placed, thereby providing a slight nominal radial interference with the well bore casing. This interference, "swabbing," or "squeeze," creates a seal to isolate a geologic zone of interest and thereby diverts the treating fluid introduced into the casing into the formation.

Packer cups were developed originally to swab wells to start a well production. In recent years, packer cups have been used in fracturing or treatment operations carried out on coiled tubing or drill pipe. Such operations require higher pressures and may require multiple sets of packers or isolations across various individual zones. The demand on the sealing performance of the packer or isolation elements is high and their integrity is critical. Thus, packer cups that are capable of withstanding the high differential pressures encountered during fracturing or treatment operations are desired. Furthermore, a cup configuration that is capable of traversing equipment or irregularities in the borehole, such as casing collars, perforation burrs, minor restrictions or wellbore damage or any other type of wellbore obstruction, with minimal cup damage is also desired.

It is with respect to the above referenced considerations and others that embodiments of the invention have been made.

SUMMARY

Various embodiments of the invention are generally directed to a packer cup for use inside a wellbore. In one embodiment, the packer cup includes a body, a support member disposed inside the body, and one or more support layers disposed against an inside diameter of the support member.

In another embodiment, the packer cup includes a body and a support member disposed inside the body. The support member includes a plurality of curved wires.

In another embodiment, the packer cup includes a body and a support member disposed inside the body. The support member includes a plurality of slats.

In yet another embodiment, the packer cup includes a body and a support member disposed inside the body. The support member is made of a composite material.

In still another embodiment, the packer cup includes a body and one or more support layers disposed inside the body. The support layers are made from a fabric material.

Other embodiments of the invention are directed to a method for straddling a perforated zone in a wellbore. The method includes attaching a packer cup to a straddling tool. The packer cup includes a body, a support member disposed inside the body, and one or more support layers disposed against an inside diameter of the support member. The method further includes deploying the straddling tool to a desired location and increasing fluid pressure inside the packer cup to squeeze the fluid into a wellbore formation, thereby isolating the perforated zone.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
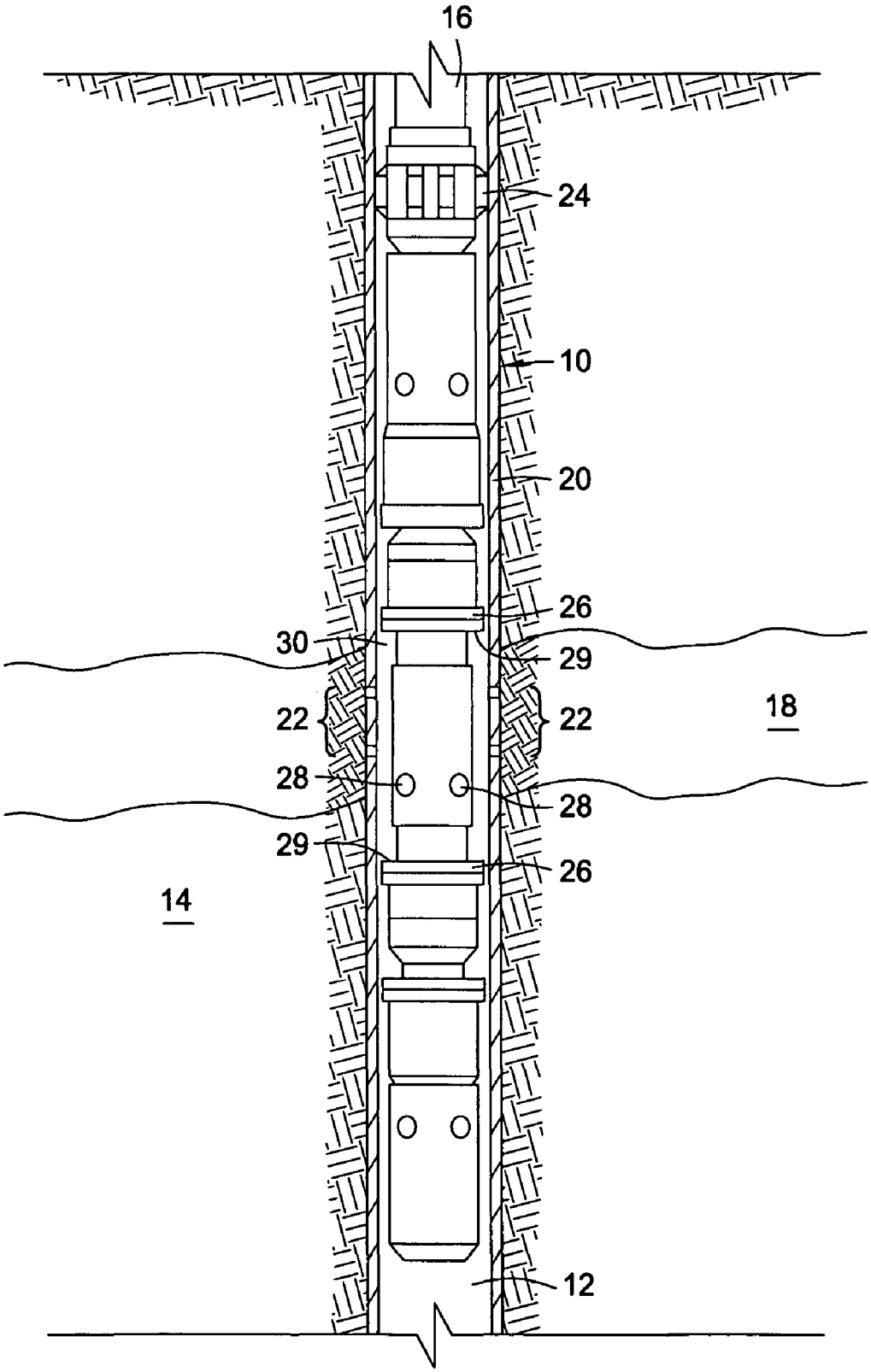
FIG. 1 illustrates a schematic diagram of a formation interval straddle tool that may be used in connection with one or more embodiments of the invention.

FIG. 1 illustrates a schematic diagram of a formation interval straddle tool 10 that may be used in connection with one or more embodiments of the invention. The straddle tool 10 is of the type typically employed for earth formation zone fracturing or other formation treating operations in wellbores. FIG. 1 illustrates the straddle tool 10 as being positioned within a cased wellbore 12, which has been drilled in an earth formation 14. The straddle tool 10 may be lowered into the wellbore 12 on a string of coiled or jointed tubing 16 to a position adjacent a selected zone 18 of the earth formation 14. The wellbore 12 may be cased with a casing 20, which has been perforated at the selected zone 18 by the firing of perforating shaped charges of a perforating gun or other perforating device, as illustrated by the perforations 22.

Once the straddle tool 10 is in position adjacent the selected formation zone 18, the straddle tool 10 may be operated from the earth's surface to deploy anchor slips 24 to lock itself firmly into the casing 20 in preparation for fracturing or treating the selected formation zone 18. The straddle tool 10 may include one or more packer cups 26. When pressurized fracturing or treating fluid is pumped from the earth's surface through the string of coiled or jointed tubing 16 to the straddle tool 10, the pressure of fluid exiting the straddle tool 10 may force the packer cups 26 to engage the casing 20 proximate one or more treating ports 28. The open ends 29 of the cup packers 26 may be arranged to face each other and straddle an interval 30 of the wellbore 12 between the packer cups 26.

When the packer cups 26 have fully engaged the casing 20, the formation zone 18 and the straddled interval 30 between the packer cups 26 will be pressurized by the incoming fracturing or treating fluid. Upon completion of fracturing or treating of the formation zone 18, the pumping of fracturing or treating fluid from the earth's surface may be discontinued, and the straddle tool 10 may be operated to dump any excess fluid, thereby relieving the pressure in the straddled interval 30.

Packer cups are generally configured to seal against extreme differential pressure. Packer cups should also be flexible in order to run into a well without becoming stuck and durable so that high differential pressure can be held without extrusion or rupture. As such, packer cups have historically been constructed from strong and tear resistant rubber materials. Examples of materials that have been used in the past include nitrile, VITON, hydrogenated nitrile, natural rubber, AFLAS, and urethane (or polyurethane). A typical elastomer is less flexible when steps are taken to improve its tensile strength. For example, a more cross-linked nitrile rubber may have higher durometer hardness and tensile strength, but it is more likely to experience high friction forces and be damaged when the rubber must flex around an obstruction in a well bore. A material that possesses the flexibility of a soft nitrile rubber but has the tear strength and tensile strength of a much harder rubber would both improve the ease with which the cup may be transported into a well bore and also improve the capability of the cup to withstand high differential pressure.

Figure 2A:
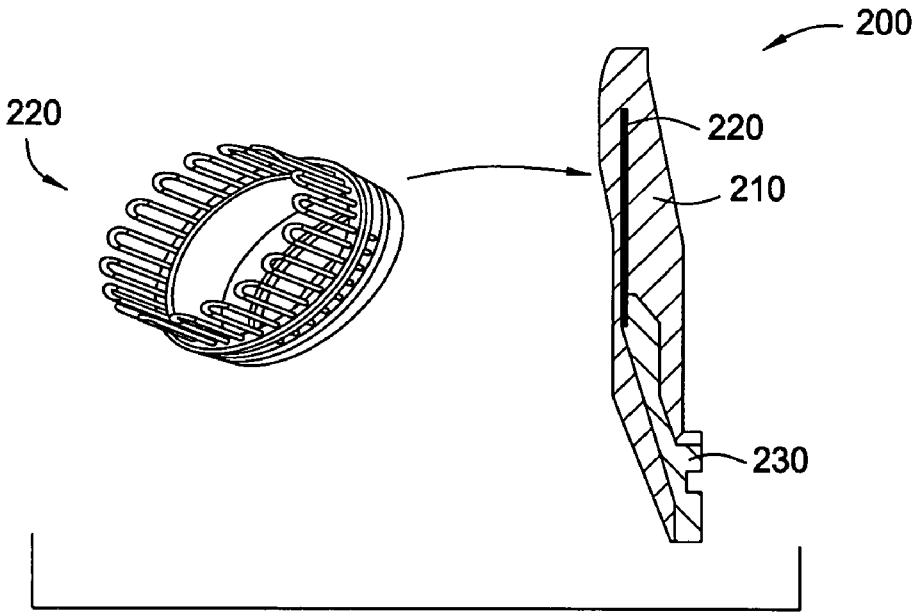
FIGS. 2A and 2B illustrate partial cross sectional diagrams of a packer cup in accordance with one or more embodiments of the invention.
Figure 2B:
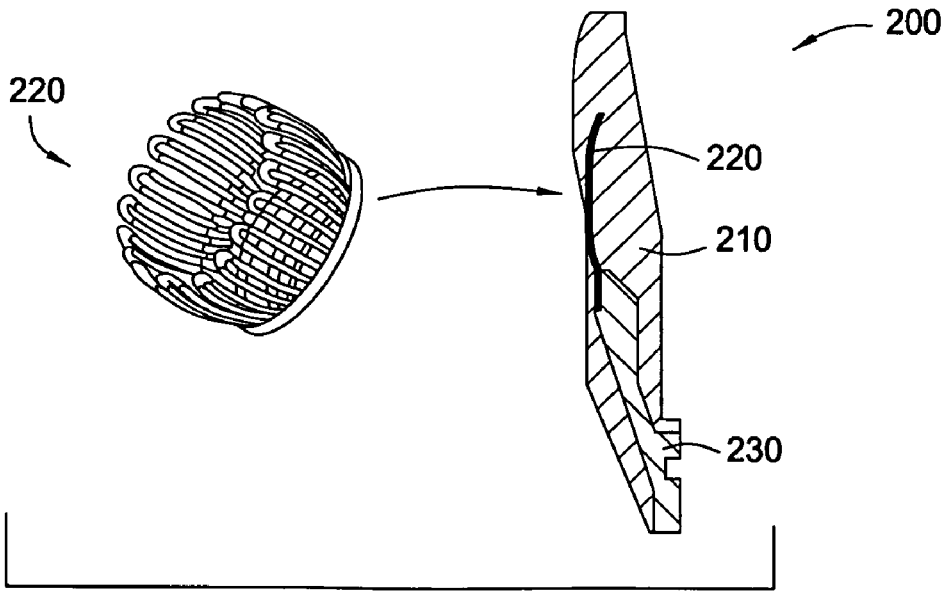

FIG. 2A illustrates a partial cross sectional diagram of a packer cup 200 in accordance with one or more embodiments of the invention. The packer cup 200 has a body 210, which may be made of rubber materials, such as nitrile, VITON, hydrogenated nitrile, natural rubber, AFLAS, and urethane (or polyurethane). In one embodiment, the body may be made from fiber-reinforced rubber (or rubber-like) materials, including nanofiber-reinforced rubber (or rubber-like) materials, nano tube reinforced rubber (or rubber-like) materials and nano particles-reinforced rubber (or rubber-like) materials. The packer cup 200 may further include a support member 220, which is configured to reinforce the body 210. The support member 220 may be attached to a metal base 230. In one embodiment, the support member 220 may include straight wires. In another embodiment, the support member 220 may include curved wires, as illustrated in FIG. 2B. The straight or curved wires may be made from any metallic material, such as steel, or nanotubes that may be molded into the body 210. The straight or curved wires may also be made from a composite material, such as glass fiber-reinforced materials, carbon fiber-reinforced materials, synthetic fiber-reinforced materials, metallic fiber-reinforced materials, nano fiber-reinforced materials and nano particles-reinforced materials. The materials mentioned herein may include metals, thermosets, thermoplastics and elastomers. The wires may be designed such that they are flexible in one direction but stiff in the other direction. By incorporating the support member 220 into the body 210, tear strength of the body 210 may be improved and extrusion of the body 210 under high pressure may be minimized. The metal base 230 may include different profiles to meet different tool configurations.

Figure 3:
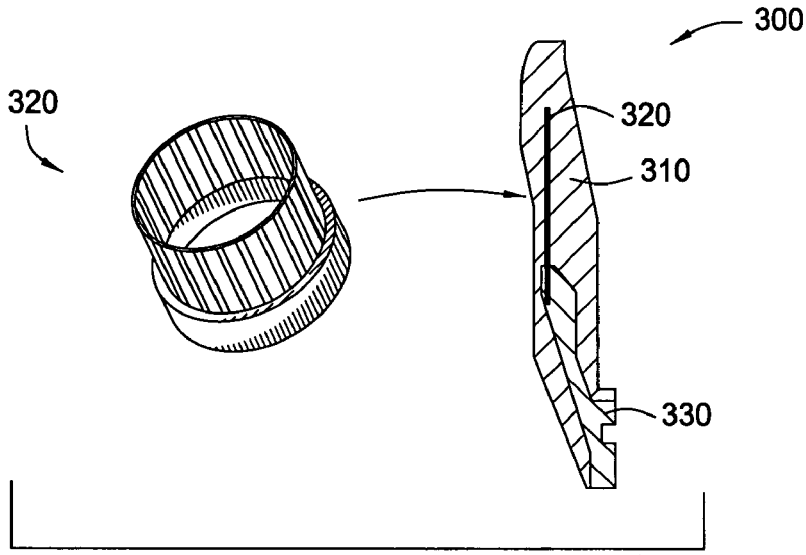
FIG. 3 illustrates a partial cross sectional diagram of a packer cup having a support member in accordance with another embodiment of the invention.

FIG. 3 illustrates a partial cross sectional diagram of a packer cup 300 having a support member 320 in accordance with another embodiment of the invention. More particularly, the support member 320 includes slats, which may be made from metallic materials, such as steel, or fiber reinforced materials, such as glass fiber-reinforced materials, carbon fiber-reinforced materials, synthetic fiber-reinforced materials, metallic fiber-reinforced materials, fiber-reinforced elastomers, nanofiber-reinforced elastomers, nanotube-reinforced elastomers, or other advanced materials. Each slat may be attached to each other in an overlapping manner. The metal base 330 may include different profiles to meet different tool configurations.

Figure 4A:
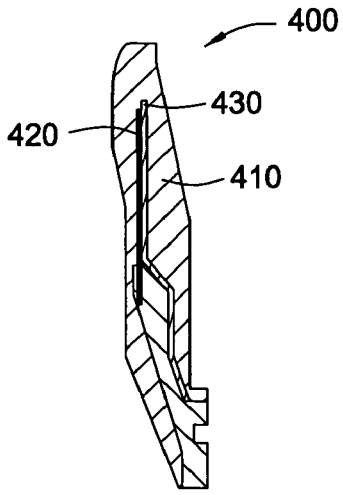
FIGS. 4A-4C illustrate partial cross sectional diagrams of a packer cup in accordance with one or more embodiments of the invention.

FIG. 4A illustrates a partial cross sectional diagram of a packer cup 400 in accordance with one or more embodiments of the invention. The packer cup 400 includes a support member 420 disposed inside a body member 410. The support member 420 may be made from the same design and materials described for the support members 220 and 320 mentioned above with reference to FIGS. 2 and 3. In one embodiment, the packer cup 400 may further include one or more support layers 430 disposed against an inside diameter of the support member 420. The support layers 430 may be made from any material that is flexible and durable, such as metallic materials, including steel, and synthetic materials, including nylon, glass fibers, organic synthetic fibers, inorganic synthetic fibers, nano fibers and nano tubes. The support layers 430 may be woven, non-woven or a mesh. In this manner, the support layers 430 may be used as an effective anti-extrusion barrier. The support layers 430 may be configured to receive the pressure load from fracturing or treating fluid and transfer the load to the support member 420, which then transfers the load to the body 410, which then transfers the load to the casing 20.

Figure 4B:
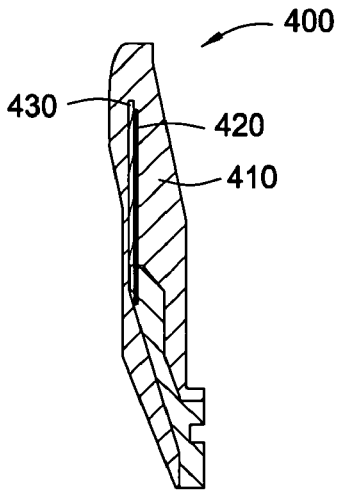
Figure 4C:
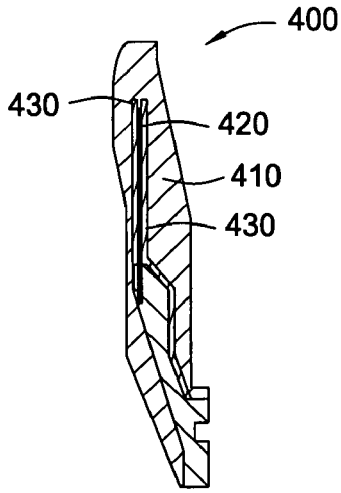

In another embodiment, the support layers 430 may be disposed outside the support member 420, as shown in FIG. 4B. For instance, the support layers 430 may be disposed against an outside diameter of the support member 420. In this manner, the support layers 430 may be used to increase the packer cup's anti-extrusion resistance. In yet another embodiment, the support layers 430 may be disposed both inside and outside the support member 420, as shown in FIG. 4C.

Figure 5A:
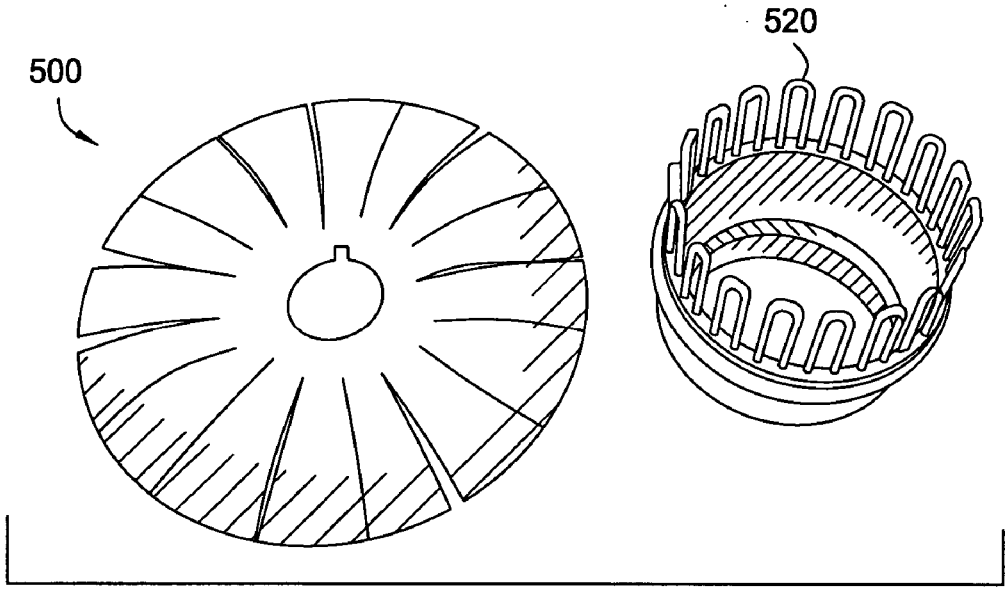
FIGS. 5A and 5B illustrate one or more support layers in accordance with one or more embodiments of the invention.
Figure 5B:
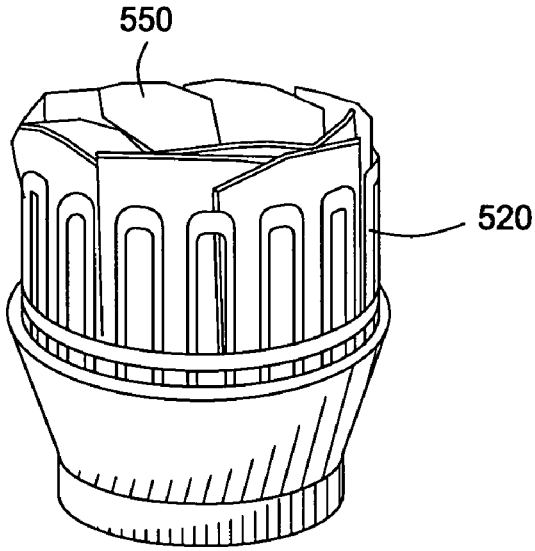

FIG. 5A illustrates one or more support layers 500 in accordance with one or more embodiments of the invention. The support layers 500 are made from a fabric material in a pedal design and defining a plurality of members 550, best seen in FIG. 5B. The very flexible and high strength fabric materials can be woven, non-woven or mesh-like. The members 550 of the support layers 500 may be folded inside the support member 520 in an overlapping manner, as shown in FIG. 5B. Various embodiments of the invention contemplate that the support layers may be made from designs other than the pedal design, such as cylindrical for example.

Figure 6:
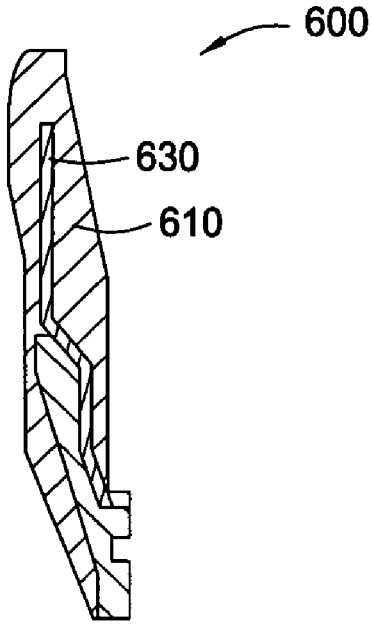
FIG. 6 illustrates a partial cross sectional diagram of a packer cup in accordance with one or more embodiments of the invention.

FIG. 6 illustrates a partial cross sectional diagram of a packer cup 600 in accordance with one or more embodiments of the invention. The packer cup 600 includes a body 610 and one or more support layers 630 disposed inside the body 610. Notably, the packer cup 600 has no support members disposed therein. The support layers 630 may be made from a fabric material or any materials described above for the various support layers embodiments.

Figure 7:
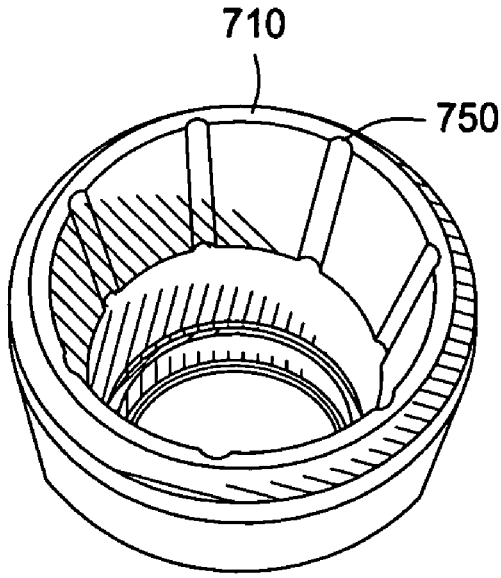
FIG. 7 illustrates a schematic diagram of a packer cup in accordance with one or more embodiments of the invention.

FIG. 7 illustrates a schematic diagram of a packer cup 700 in accordance with one or more embodiments of the invention. The packer cup 700 includes a body 710 having a plurality of grooves or channels 750 formed in an inner surface of the packer cup 700 and disposed along the axis of the cup 700. The grooves or channels 750 are designed to provide the packer cup 700 with more flexibility.

While the foregoing is directed to embodiments of the present invention, other and further embodiments of the invention may be devised without departing from the basic scope thereof, and the scope thereof is determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A packer cup for use inside a wellbore, comprising:

a body, the body including a plurality of channels formed in an inner surface of the packer cup and disposed along an axis of the packer cup;

a support member disposed inside and extending along the axis of the body;

one or more support layers disposed inside and extending along the axis of the body against one of an inside and an outside diameter of the support member and along the length of the support member; and a base disposed inside the body, wherein at least one of the support member and the one or more support layers are attached to the base and extend from the base into the body along the axis of the body.

2. The packer cup of claim 1, wherein the support layers are made from a metallic material.

3. The packer cup of claim 1, wherein the support layers are made from a synthetic material.

4. The packer cup of claim 1, wherein the support member is made from a composite material.

5. The packer cup of claim 1, wherein the support member comprises a plurality of straight wires.

6. The packer cup of claim 1, wherein the support member comprises a plurality of curved wires.

7. The packer cup of claim 1, wherein the support layers are configured to reinforce the support member.

8. The packer cup of claim 1, wherein the support layers comprise a plurality of axially extending members folded in an overlapping pedal design.

9. The packer cup of claim 1, wherein the support layers are folded into a cylindrical shape to match the inside diameter of the support member.

10. The packer cup of claim 1, wherein the support member comprises one or more slats.

11. The packer cup of claim 10, wherein the slats are made from a metallic material.

12. The packer cup of claim 10, wherein the slats are made from a fiber-reinforced material.

13. The packer cup of claim 1, wherein the body is made from a fiber-reinforced rubber material.

14. The packer cup of claim 1, further comprising one or more support layers disposed against an inside diameter of the support member.

15. A packer cup for use inside a wellbore, comprising:

a body; and a support member disposed inside the body; and at least one support layer disposed inside the support member, wherein the support layer is made from a fabric material, and wherein the at least one support layer comprises a plurality of axially extending members folded in an overlapping manner.

16. The packer cup of claim 15, wherein the one or more support layers are a pedal design.

17. The packer cup of claim 15, wherein the one or more support layers are a cylindrical design.

18. The packer cup of claim 15, wherein the body includes a plurality of channels formed in an inner surface of the packer cup and disposed along an axis of the packer cup.

19. A method for straddling a perforated zone in a wellbore, comprising:

attaching a packer cup to a straddling tool, wherein the packer cup comprises:

a body;

a support member disposed inside the body; and one or more support layers disposed against an inside diameter of the support member, wherein the support layer comprises a plurality of axially extending members folded in an overlapping manner;

deploying the straddling tool to a desired location; and increasing fluid pressure inside the packer cup to squeeze the fluid into a wellbore formation, thereby isolating the perforated zone.

20. The method of claim 19 wherein the body includes a plurality of channels formed in an inner surface of the packer cup and disposed along an axis of the packer cup.

21. A packer cup for use inside a wellbore, comprising:

a body;

a support member disposed inside and extending along the axis of the body for preventing extrusion of the body through the support member, wherein the support member comprises a plurality of support members defining circumferential openings therebetween and further comprises at least one support layer extending along the axis of the body against one of an inside and an outside diameter of the support member and forming an anti-extrusion barrier for the body.

22. A packer cup for use inside a wellbore, comprising a body;

a support member comprising one or more slats disposed inside and extending along the axis of the body for preventing extrusion of the body through the support member, wherein the slats are attached to each other in an overlapping manner.

* * * * *